US008928253B2

(12) United States Patent
Bergeler et al.

(10) Patent No.: US 8,928,253 B2
(45) Date of Patent: Jan. 6, 2015

(54) METHOD FOR GENERATING LIGHT WITH A DESIRED LIGHT COLOUR BY MEANS OF LIGHT-EMITTING DIODES

(71) Applicant: Diehl Aerospace GmbH, Ueberlingen (DE)

(72) Inventors: Swen Bergeler, Allerhagen (DE); Yvonne Bodschwinna-Kangarakis, Nuremberg (DE); Frank Schmid, Poppenricht (DE)

(73) Assignee: Diehl Aerospace GmbH, Ueberlingen (DE)

( * ) Notice: Subject to any disclaimer, the term of this patent is extended or adjusted under 35 U.S.C. 154(b) by 0 days.

(21) Appl. No.: 13/767,364

(22) Filed: Feb. 14, 2013

(65) Prior Publication Data

US 2013/0207570 A1 Aug. 15, 2013

(30) Foreign Application Priority Data

Feb. 15, 2012 (DE) ..... 10 2012 003 018

(51) Int. Cl.
*G05F 1/00* (2006.01)
*H05B 37/02* (2006.01)
*H05B 33/08* (2006.01)

(52) U.S. Cl.
CPC ..... *H05B 37/02* (2013.01); *H05B 33/086* (2013.01)
USPC ..... 315/294; 315/3; 315/308; 315/312; 315/324; 345/69.3; 345/307; 345/589; 345/598; 345/599; 345/600; 345/602; 345/603; 345/591; 345/690

(58) Field of Classification Search
CPC ..... H05H 37/02
USPC ..... 315/294, 312, 297, 158; 345/690 I, 345/589–603
See application file for complete search history.

(56) References Cited

U.S. PATENT DOCUMENTS

| | | | | |
|---|---|---|---|---|
| 6,342,897 | B1 * | 1/2002 | Wen | 345/589 |
| 6,552,495 | B1 * | 4/2003 | Chang | 315/169.3 |
| 7,354,172 | B2 * | 4/2008 | Chemel et al. | 362/231 |
| 7,379,561 | B2 * | 5/2008 | Chauville et al. | 382/103 |
| 7,411,701 | B2 * | 8/2008 | Boll | 358/1.9 |

(Continued)

FOREIGN PATENT DOCUMENTS

| | | | |
|---|---|---|---|
| DE | 10 2008 016 756 | A1 | 10/2009 |
| WO | WO 2006/109237 | A1 | 10/2006 |

OTHER PUBLICATIONS

English Abstract of WO 2009/121539 A1, dated Oct. 8, 2009 (corresponding to DE 10 2008 016 756 A1).

*Primary Examiner* — Douglas W Owens
*Assistant Examiner* — Srinivas Sathiraju
(74) *Attorney, Agent, or Firm* — Scully, Scott, Murphy & Presser, P.C.

(57) ABSTRACT

The invention relates to a method for generating light with a desired light color by using at least one light-emitting diode emitting red r-LED, at least one light-emitting diode emitting green g-LED, at least one light-emitting diode emitting blue b-LED and at least one light-emitting diode emitting white w-LED. In order to improve the CRI value, according to the invention it is proposed that weighting values ascertained according to the RGB algorithm and further weighting values ascertained according to the RGBW algorithm be combined together by using a correction factor.

5 Claims, 4 Drawing Sheets

(56) References Cited

U.S. PATENT DOCUMENTS

| | | | | |
|---|---|---|---|---|
| 7,561,167 | B2 * | 7/2009 | Nitta et al. | 345/603 |
| 7,859,554 | B2 * | 12/2010 | Young | 345/690 |
| 7,907,154 | B2 * | 3/2011 | Rykowski et al. | 345/690 |
| 7,911,485 | B2 * | 3/2011 | Rykowski et al. | 345/690 |
| 7,956,821 | B2 * | 6/2011 | Ikeno et al. | 345/4 |
| 8,061,856 | B2 * | 11/2011 | Shirai et al. | 353/99 |
| 8,115,410 | B2 * | 2/2012 | Baaijens et al. | 315/291 |
| 8,115,787 | B2 * | 2/2012 | Ben-Chorin et al. | 345/690 |
| 8,223,166 | B2 * | 7/2012 | Brown Elliott | 345/596 |
| 8,305,395 | B2 * | 11/2012 | Ramanath et al. | 345/604 |
| 8,310,498 | B2 * | 11/2012 | Ben-Chorin et al. | 345/589 |
| 8,319,701 | B2 * | 11/2012 | Ikeno et al. | 345/4 |
| 8,525,444 | B2 * | 9/2013 | Van Duijneveldt | 315/308 |
| 8,610,376 | B2 * | 12/2013 | Chemel et al. | 315/308 |
| 8,610,377 | B2 * | 12/2013 | Chemel et al. | 315/308 |
| 8,624,527 | B1 * | 1/2014 | Meir et al. | 315/318 |
| 8,624,941 | B2 * | 1/2014 | Young | 345/690 |
| 8,638,044 | B2 * | 1/2014 | Briggs | 315/291 |
| 8,692,740 | B2 * | 4/2014 | Yoshida et al. | 345/76 |
| 8,724,195 | B2 * | 5/2014 | Chang | 358/518 |
| 2011/0012512 | A1 | 1/2011 | Young et al. | |
| 2012/0092318 | A1 * | 4/2012 | Mishra et al. | 345/211 |
| 2013/0207570 | A1 * | 8/2013 | Bergeler et al. | 315/294 |

* cited by examiner

METHOD FOR GENERATING LIGHT WITH A DESIRED LIGHT COLOUR BY MEANS OF LIGHT-EMITTING DIODES

BACKGROUND OF THE INVENTION

The invention relates to a method for generating light with a desired light colour by using at least one light-emitting diode emitting red, at least one light-emitting diode emitting green, at least one light-emitting diode emitting blue and at least one light-emitting diode emitting white.

DISCUSSION OF THE PRIOR ART

According to the prior art, U.S. Pat. No. 6,552,495 B1 discloses a method for generating light with a desired light colour, in which light-emitting diodes that emit red, green and blue light are used as light sources. In order to adjust the desired light colour, a colour locus corresponding to the desired light colour is determined in the CIE standard colour space diagram. Then, for the r-LED, the further colour locus corresponding thereto in the CIE standard colour space diagram is determined. From the inverse distance between the further colour locus of the r-LED and the colour locus, a first weighting value W1_r is obtained for the r-LED. Likewise, further first weighting values W1_g and W1_b are determined for the g-LED and for the b-LED. The method for determining the aforementioned first weighting values with the use of an r-LED, g-LED and b-LED is also referred to as the so-called "RGB algorithm".

In the case of using the RGB algorithm, the colour rendering index, or CRI value, is dependent on the properties of the LEDs and the solution of the RGB algorithm. For a predetermined colour locus, the CRI value is not constant over the spectrum of the colour temperatures. Besides this, the maximum values of the CRI value scarcely reach more than 90%.

In order to overcome this disadvantage, DE 10 2008 016 756 A1 and WO 2006/109237 A1 disclose the so-called "RGBW algorithm", in which a light-emitting diode emitting white w-LED is used in addition to the r-LED, g-LED and b-LED. According to the RGBW algorithm as well, weighting values between the further colour loci of the respective LEDs and the colour locus corresponding to the desired colour are determined in a manner corresponding to the RGB algorithm. When using the RGBW algorithm, it is possible to achieve CRI values of more than 90% over wide ranges of the colour temperature spectrum. In a colour temperature interval between 3800 and 5000 K, however, the CRI values fall off to a minimum which lies significantly below 90%.

SUMMARY OF THE INVENTION

It is an object of the invention to provide a method by which light with a desired light colour, having a high CRI value which is substantially constant in the spectrum of the colour temperatures, can be generated by using LEDs.

This object is achieved by the features of claim 1. Expedient configurations of the invention are given by the features of claims 2 to 4.

The invention provides a method for generating light with a desired light colour by using at least one light-emitting diode emitting red r-LED, at least one light-emitting diode emitting green g-LED, at least one light-emitting diode emitting blue b-LED and at least one light-emitting diode emitting white w-LED, comprising the following steps:

determining a colour locus of the light in the CIE standard colour space diagram, ascertaining first weighting values W1_r, W1_g, W1_b relating to further colour loci for the r-LED, g-LED and the b-LED by means of the RGB algorithm, a first weighting value for the w-LED being zero;

ascertaining second weighting values W2_r, W2_g, W2_b and W2_w relating to the further colour loci for the r-LED, g-LED, b-LED and the w-LED by means of the RGBW algorithm;

calculating a factor from the second weighting value W2_r according to the following formula:

$$K=A-W2_r,$$

where A is a real number in the range of between 0.3 and 0.5; and calculating overall weighting factors WG_r, WG_g, WG_b, WG_w for the r-LED, g-LED, b-LED and the w-LED according to the following relation:

$$WG_r=W1\text{-}r*K+W2_r$$

$$WG_g=W1\text{-}g*K+W2_g$$

$$WG_b=W1\text{-}b*K+W2_b$$

$$WG_w=W1\text{-}w*K+W2_w.$$

The term "CIE standard colour space diagram" is generally intended to mean a standardized colour space system in which the standard colour values are defined and specified in an additive colour model comprising three components. In this case, it is possible in particular to use the CIELUV colour space system from the year 1976, the CIE standard valency system (CIE 1931), the CIELAB colour space or the like. In the present invention, the CIELUV colour space system in which colour loci are established by u' and v' values in the u'v' chromaticity plane is preferably used.

According to the method according to the invention, it is proposed that the first weighting values ascertained in the conventional way according to the RGB algorithm and the second weighting values ascertained in the conventional way according to the RGBW algorithm be combined together, the first weighting values respectively being multiplied by a factor K which is obtained by subtracting the second weighting value for the r-LED from a number A which is selected in the range of between 0.3 and 0.5. The overall weighting factors resulting therefrom for the respective LEDs give a light colour whose CRI value is substantially constant in the spectrum of the colour temperatures and lies above 90% over wide ranges. When using the method according to the invention, the CRI value even reaches values of up to 96%. It is therefore possible to generate light with a high quality of the colour rendering by using red, green, blue and white LEDs. Such light is perceived as particularly agreeable by humans because it substantially corresponds to sunlight, which has a CRI value of 100%.

According to an advantageous configuration, A is a real number in the range of from 0.35 to 0.45, preferably 0.4. The factor K resulting therefrom leads to particularly high CRI values which are substantially constant with respect to the colour temperature.

Expediently, the weighting values are obtained from the inverse distance of the colour locus from the further colour locus of the respective LED.

From the overall weighting values ascertained according to the invention, corresponding current or pulse-width modulation values for driving the respective LEDs are advantageously generated. Corresponding driver devices, with which LEDs can be driven by using current or pulse-width modulation values, are known according to the prior art and are familiar to the person skilled in the art.

BRIEF DESCRIPTION OF THE DRAWINGS

An exemplary embodiment of the invention will be explained in more detail below with the aid of the drawing, in which.

DETAILED DESCRIPTION OF THE INVENTION

The method according to the invention will be described with the aid of weighting values for determining the pulse-width modulation ratio for an r-LED, g-LED, b-LED and a w-LED. It may be used in a similar way in order to ascertain weighting values for the current or the like.

Figure 1:
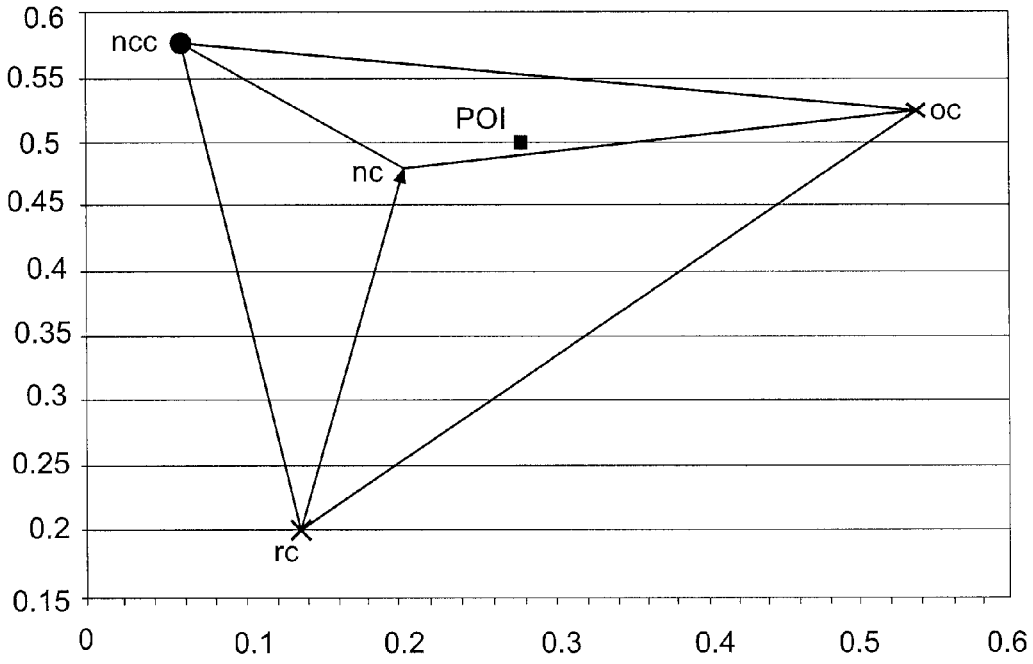
FIG. 1 shows a CIELUV colour space diagram.

In a first step, the colour locus corresponding to the desired light colour is expediently plotted in the CIELUV standard colour space diagram. The desired colour locus is denoted by the reference POI in FIGS. 1 and 2.

Then, in a second step, the further colour loci corresponding to the LEDs are plotted. The reference nc denotes the further colour locus of the w-LED, the reference oc denotes the further colour locus of the b-LED, the reference ncc denotes the further colour locus of the r-LED and the reference rc denotes the further colour locus of the g-LED.

Figure 2:
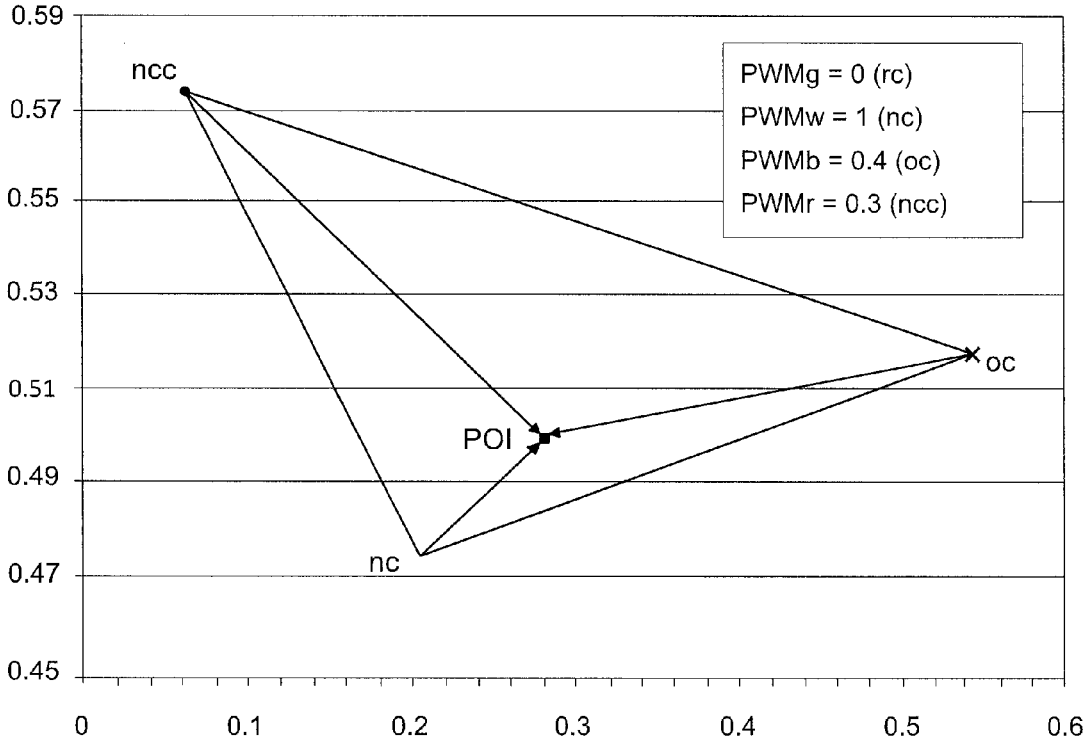
FIG. 2 shows an enlarged detail of the CIELUV colour space diagram according to FIG. 1.

In a third step, the sub-triangle in which the colour locus POI lies is then considered according to the RGBW algorithm. This sub-triangle is shown in FIG. 2. The sub-triangle in each case contains the colour locus of the w-LED, i.e. one of the further colour loci of the other LEDs is neglected.

In a fourth step, the pulse-width modulation ratio is then determined with normalization to 1 for the three LEDs forming the sub-triangle. In the example shown in FIG. 2, these are the w-LED, b-LED and the r-LED. As can be seen from FIG. 2, the distance between the colour locus POI and the further colour locus of the w-LED is the least. Consequently, the inverse distance is the greatest in this case. This value is normalized to 1. The other values for the further colour loci oc and ncc are obtained by taking into account the normalization as 0.4 (oc) and 0.3 (ncc) for the b-LED and the r-LED.

In a fifth step, three pulse-width modulation values are then in turn ascertained in a similar way according to the RGB algorithm. In this case, the further colour loci for the r-LED, g-LED and the b-LED are plotted in the colour space diagram. Furthermore, the desired colour locus POI is in turn plotted in the colour space diagram, and weighting values are ascertained in a similar way.

In a sixth step, overall weighting values are then ascertained by taking the factor K into account.

EXAMPLE

RGB algorithm:

$$W1_r=0.853;\ W1_g=1;\ W1_b=0.168;\ W1_w=0$$

RGBW algorithm:

$$W2_r=0.06;\ W2_g=0;\ W2_b=0.0526;\ W2_w=1$$

$$K=0.4-W2_r=0.4-0.06=0.34$$

Calculation:

$$WG_r=0.34*0.853+0.06=0.35$$

$$WG_g=0.34*1+0=0.34$$

$$WG_b=0.34*0.168+0.0526=0.11$$

$$WG_w=0.34*0+1=1$$

For the weighting factors ascertained according to the RGB algorithm, a CRI value of 81% is obtained for the colour locus POI.

For the weighting factors ascertained according to the RGBW algorithm, a CRI value of 87% is obtained for the colour locus POI.

For the overall weighting factors calculated according to the method according to the invention, a CRI value of 94.6% is obtained for the colour locus POI.

Figure 3:
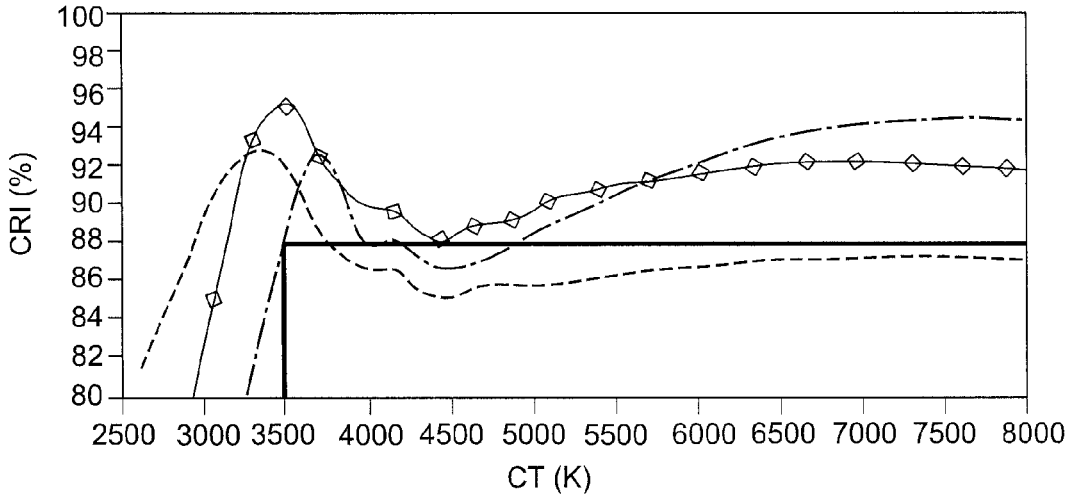
FIG. 3 shows the CRI value as a function of the colour temperature according to the RGBW algorithm and FIG. 4 shows the CRI value as a function of the colour temperature according to the method according to the invention.
Figure 4:
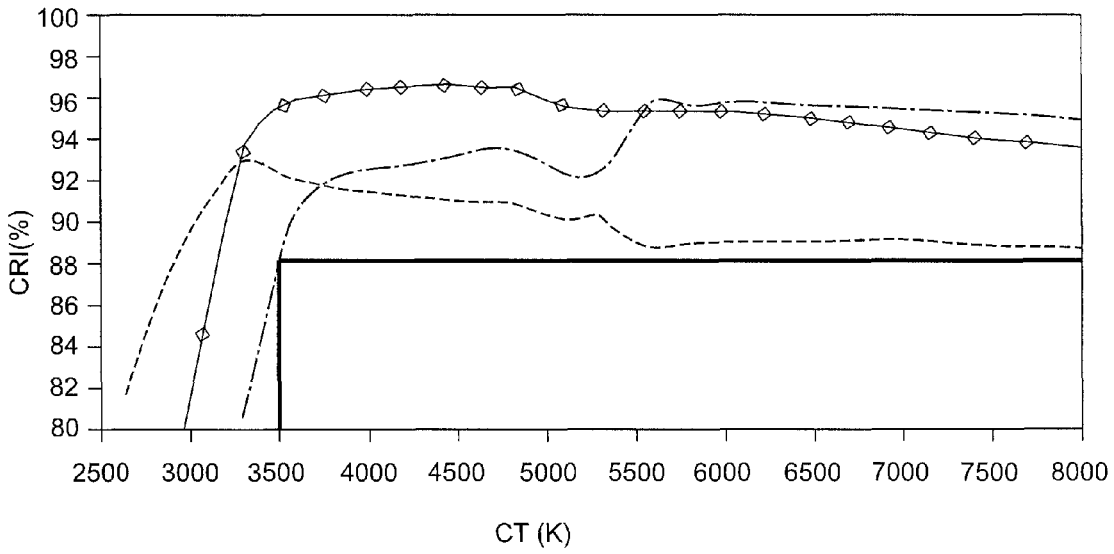

FIGS. 3 and 4 respectively show the CRI value as a function of the colour temperature CT for three different combinations of conventional LEDs. FIG. 3 shows the dependency of the colour temperature when using the RGBW algorithm. The CRI values in this case have a minimum in the region of 4500 K. There, the CRI values lie in the range of between 85 and 88%.

FIG. 4 likewise shows the CRI value for different combinations of commercially available LEDs as a function of the colour temperature, the method according to the invention having been used in this case. As is clear from FIG. 4, the CRI values do not have a minimum in the range of the colour temperature in the region of 4500 K here. Above a colour temperature of 3500 K, the CRI value is constantly above 88% and reaches values of just over 96%.

What is claimed is:

1. A method for generating light with a desired light colour by using at least one light-emitting diode emitting red r-LED, at least one light-emitting diode emitting green g-LED, at least one light-emitting diode emitting blue b-LED and at least one light-emitting diode emitting white w-LED, comprising the following steps:

determining a colour locus (POI) of the light in the CIE standard colour space diagram, ascertaining first weighting values W1_r, W1_g, W1_b relating to further colour loci (oc, ncc, rc, nc) for the r-LED, g-LED and the b-LED by means of an RGB algorithm, a first weighting value for the w-LED being zero;

ascertaining second weighting values W2_r, W2_g, W2_b and W2_w relating to the further colour loci (oc, ncc, rc, nc) for the r-LED, g-LED, b-LED and the w-LED by means of an RGBW algorithm;

calculating a factor K from the second weighting value W2_r according to the following formula:

K=A−W2_r, where A is a real number in the range of between 0.3 and 0.5; and calculating overall weighting factors WG_r, WG_g, WG_b, WG_w for the r-LED, g-LED, b-LED and the w-LED according to the following relation:

$$WG_r=W1\text{-}r*K+W2_r$$

$$WG_g=W1\text{-}g*K+W2_g$$

$$WG_b=W1\text{-}b*K+W2_b$$

$$WG_w=W1\text{-}w*K+W2_w.$$

2. The method according to claim 1, wherein A is a real number in the range of from 0.35 to 0.45.

3. The method according to claim 1, wherein A is 0.4.

4. The method according to claim 1, wherein the weighting values (W1_r, W1_g, W1_b, W2_r, W2_g, W2_b, W2_w) are obtained from the inverse distance of the colour locus (POI) from the further colour locus (oc, nc, rc, ncc) of the respective LED (r-LED, g-LED, B-LED, w-LED).

5. The method according to claim 1, wherein corresponding current or pulse-width modulation values for driving the respective LED (r-LED, g-LED, b-LED, w-LED) are generated from the overall weighting values (WG_r, WG_g, WG_b, WG_w).

* * * * *